US006817587B2

(12) United States Patent
Lin

(10) Patent No.: US 6,817,587 B2
(45) Date of Patent: Nov. 16, 2004

(54) MOBILE COMPUTER RACK

(76) Inventor: Chin-Chih Lin, 3F, No. 128, Cha-Zhuang 1st Street, Kuei Shan, Taoyuan Hsien (TW)

( * ) Notice: Subject to any disclaimer, the term of this patent is extended or adjusted under 35 U.S.C. 154(b) by 0 days.

(21) Appl. No.: 10/251,837

(22) Filed: Sep. 23, 2002

(65) Prior Publication Data

US 2004/0026590 A1 Feb. 12, 2004

(30) Foreign Application Priority Data

Aug. 12, 2002 (TW) ..... 91212431 U

(51) Int. Cl.[7] ..... A47B 91/00

(52) U.S. Cl. ..... 248/346.04; 248/346.03; 248/918; 248/316.4; 248/298.1; 108/143; 108/136; 312/223.2

(58) Field of Search ..... 248/346.04, 346.03, 248/918, 510, 680, 176.1, 298.1, 316.4, 678, 920–924; 108/40, 44, 55.1, 64, 65, 59.3, 143, 136; 312/223.2, 208.1; 361/680, 681, 682, 683

(56) References Cited

U.S. PATENT DOCUMENTS 4,913,390 A * 4/1990 Berke ..... 248/176.3
5,553,824 A * 9/1996 Dutra, Jr. ..... 248/346.07
5,623,869 A * 4/1997 Moss et al. ..... 108/43
5,673,628 A * 10/1997 Boos ..... 108/44
5,836,183 A * 11/1998 Derman ..... 70/58
5,839,713 A * 11/1998 Wright ..... 248/346.01
6,179,261 B1 * 1/2001 Lin ..... 248/274.1
6,259,601 B1 * 7/2001 Jaggers et al. ..... 361/690
6,382,580 B1 * 5/2002 Wisniewski ..... 248/316.4
6,466,438 B1 * 10/2002 Lim ..... 361/687
6,491,268 B1 * 12/2002 Channer et al. ..... 248/176.1
6,491,276 B1 * 12/2002 Belliveau ..... 248/372.1
6,570,770 B1 * 5/2003 Ross et al. ..... 361/752
6,585,212 B2 * 7/2003 Carnevali ..... 248/346.07

* cited by examiner

*Primary Examiner*—Kimberly Wood
(74) *Attorney, Agent, or Firm*—Troxell Law Office PLLC

(57) ABSTRACT

A mobile computer rack is constructed to include a mounting plate and a carrier plate relatively slidably coupled to each other, a spring connected between the carrier plate and the mounting plate and adapted to pull the carrier plate and the mounting plate toward each other, a front sliding track and a rear sliding track respectively located on the carrier plate and the mounting plate and adapted to hold down a mobile computer on the mobile compute rack when the carrier plate pulled out of the mounting plate, and a plurality of sliding retainers respectively mounted in the front and rear sliding tracks and adapted to secure the loaded mobile computer in position.

9 Claims, 4 Drawing Sheets

MOBILE COMPUTER RACK

BACKGROUND OF THE INVENTION

1. Field of the Invention

The present invention relates to a computer rack and, more specifically, to a mobile computer rack adapted for installing in a computer desk to carry a mobile computer for operation comfortably.

2. Description of the Related Art

A variety of mobile computers, for example, notebook computers and tablet computers are commercially available and highly accepted by consumers for the advantages of high mobility. However, it is not comfortable to operate a mobile computer on a desk or table. The user's neck or spine may ache or become hard to move when the user continuously operated the mobile computer on the desk or table for a length of time.

There are commercially available mobile computer racks adapted to hold a mobile computer on a desk or table for operation comfortably. However, these mobile computer racks are specifically designed for a particular model of mobile computers. They cannot be adjusted to fit different mobile computers. Further, when using a mobile computer rack to hold a mobile computer in a desk or table, the mobile computer rack may block the dissipation of heat from the mobile computer in a particular direction.

SUMMARY OF THE INVENTION

The present invention has been accomplished under the circumstances in view. It is therefore the main object of the present invention to provide a mobile computer rack, which fits any of a variety of mobile computers.

It is another object of the present invention to provide a mobile computer rack, which can be conveniently installed in a desk or table to hold any of a variety of mobile computers for operation comfortably.

It is still another object of the present invention to provide a mobile computer rack, which provides good ventilation for quick dissipation of heat from the loaded mobile computer.

To achieve these and other objects of the present invention, the mobile computer rack comprises a mounting plate, the mounting plate comprising a flat body adapted to support a mobile computer, two sliding rails provided at two opposite lateral sides of the flat body, a longitudinal groove located on the flat body on the middle between the sliding rails, a rear sliding track transversely extended along a rear side of the flat body, and a hook provided in one end of the longitudinal groove near the rear sliding track, a carrier plate coupled to the mounting plate, the carrier plate comprising a planar bearing face adapted to support the mobile computer carried on the flat body of the mounting plate, two side tracks extended along two opposite lateral sides of the planar bearing face and respectively coupled to the sliding rails of the mounting plate for enabling the carrier plate to be moved in and out of the mounting plate, a bottom hook provided on the middle, and a front sliding track transversely extended along a front side of the planar bearing face and adapted to work with the rear sliding track to hold the loaded mobile computer on the planar bearing face of the carrier plate and the flat body of the mounting plate, spring means connected between the hook of the carrier plate and the hook of the mounting plate and adapted to pull the carrier plate toward the mounting plate, and a plurality of sliding retainers respectively slidably mounted in the front sliding track and the rear sliding track and adapted to hold down the loaded mobile computer on the planar bearing face of the carrier plate and the flat body of the mounting plate.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENT

Figure 1:
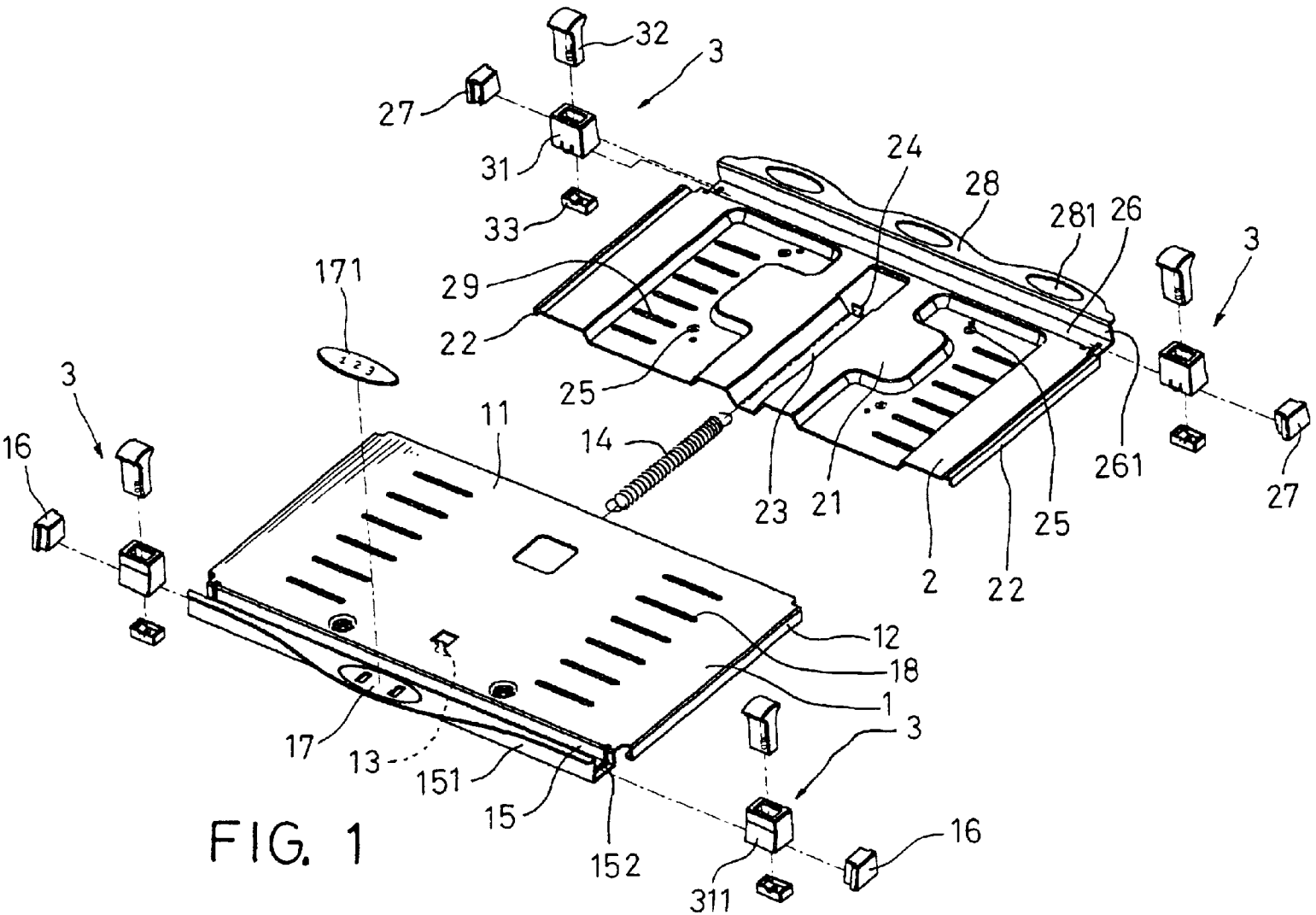
FIG. 1 is an exploded view of a mobile computer rack constructed according to the present invention.
Figure 2:
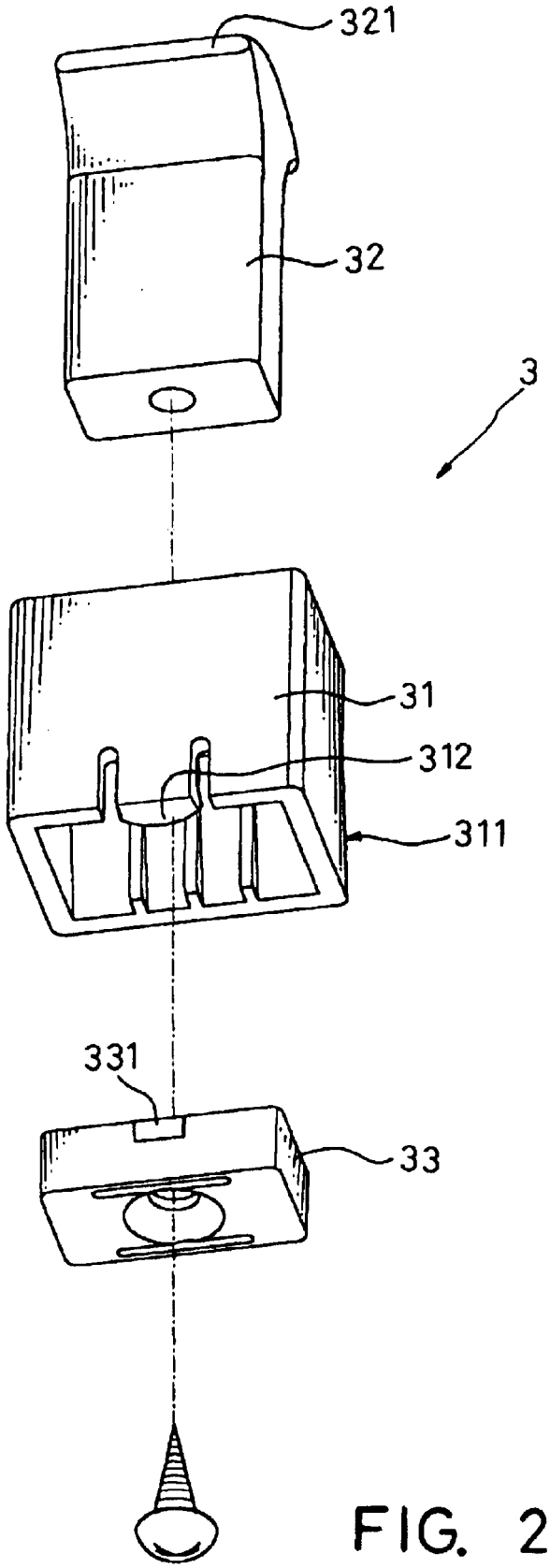
FIG. 2 is an exploded view in an enlarged scale of a part of the present invention, showing the structure of the sliding retainer.
Figure 3:
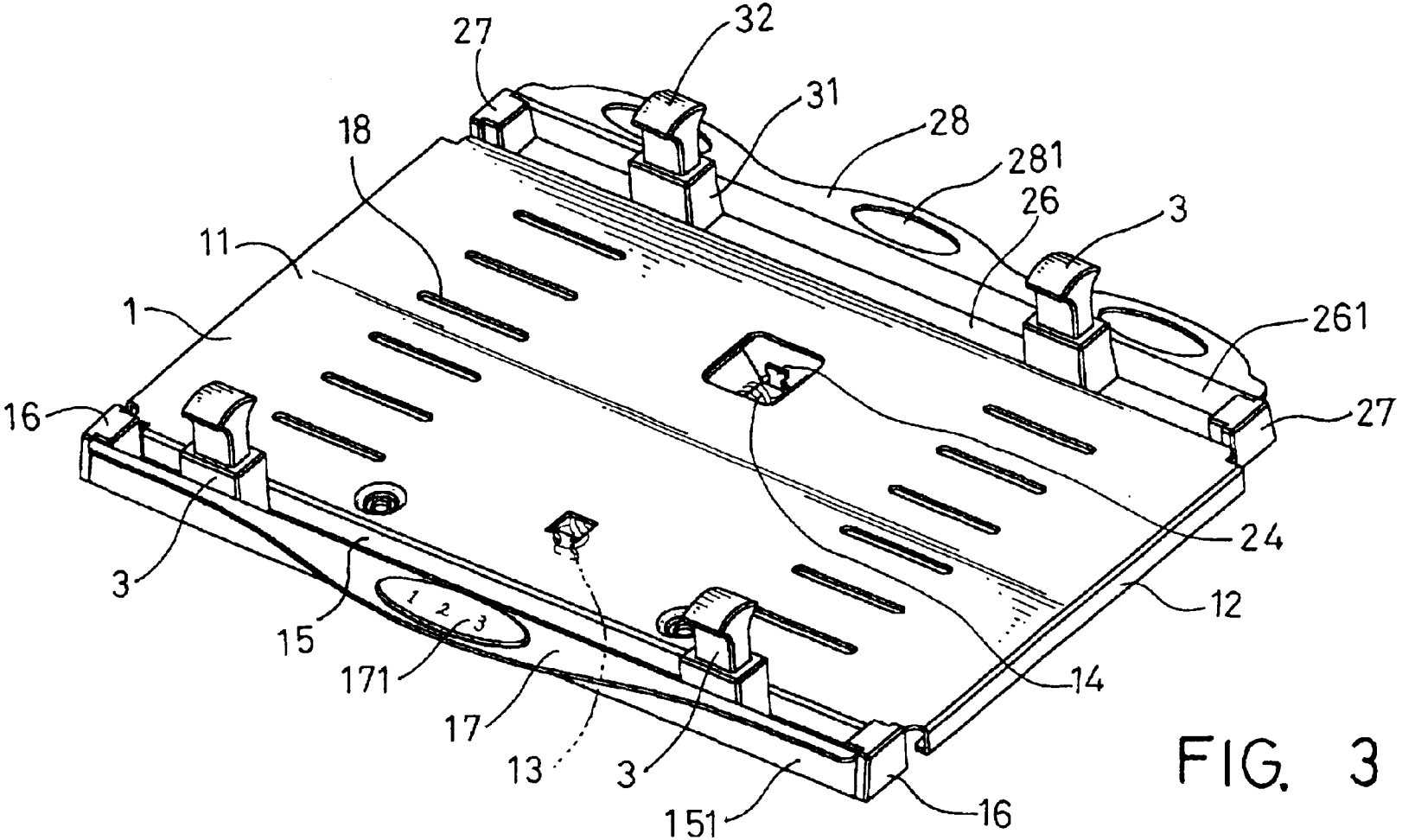
FIG. 3 is an assembly view in an enlarged scale of the mobile computer rack shown in FIG. 1.

Referring to FIGS. 1~3, a mobile computer rack in accordance with the present invention is shown comprised of a carrier plate 1, a mounting plate 2, and a plurality of sliding retainers 3.

The carrier plate 1 comprises a planar bearing face 11 adapted to hold a mobile computer, two side tracks 12 extended along two opposite lateral sides of the planar bearing face 11, a bottom hook 13 provided on the middle near the front side and hooked on one end of a spring member 14, a front sliding track 15 transversely extended along the front side of the planar bearing face 11 for receiving the sliding retainers 3 selectively, two end caps 16 respectively fastened to the two distal open ends 152 of the front sliding track 15, a front handle 17 provided at the front side of the sliding track 15, and a nameplate 171 located on the front handle 17 to show a trademark or design, and a plurality of elongated air vents 18 through the top and bottom surfaces of the planar bearing face 11. Further, the front sliding track 15 has one sidewall 151 sloping in one direction and adapted to stop the loaded sliding retainers 3 from escaping out of the front sliding track 15 in vertical direction. According to this embodiment, the air vents 18 are arranged into two parallel rows.

The mounting plate 2 fits the carrier plate 1 in size, comprising a flat body 21, two sliding rails 22 provided at two opposite lateral sides of the flat body 21 and respectively coupled to the side tracks 12 for enabling the carrier plate 1 to be moved forwards and backwards relative to the mounting plate 2, a longitudinal groove 23 located on the flat body 21 on the middle between the sliding rails 22, a hook 24 provided in one end of the longitudinal groove 23 near the rear side of the mounting plate 2 and hooked on the other end of the spring member 14, a plurality of mounting holes 25 for enabling the mounting plate 2 to be fastened to brackets (see U.S. Pat. Nos. 5,839,373; 5,881,984; and Ser. No. 09/955,054), a rear sliding track 26 transversely extended along the rear side of the flat body 21 for receiving the sliding retainers 3 selectively, two end caps 27 respectively fastened to the two distal open ends 262 of the rear sliding track 26, a rear extension plate 28 horizontally provided at the rear side of the rear sliding track 26, a plurality of openings 281 in the rear extension plate 28 for the installation of a lock used to lock the mobile computer at the mobile computer rack, and a plurality of elongated air vents 29 through the top and bottom surfaces of the flat body 21. Further, the rear sliding track 26 has one sidewall 261 sloping in one direction and adapted to stop the loaded sliding retainers 3 from escaping out of the rear sliding track 26 in vertical direction.

The sliding retainers 3 each are comprised of a shell 31, a retaining rod 32, and a bottom block 33. The retaining rod 32 is inserted through the shell 31, having a bottom end fixedly fastened to the bottom block 33 and a top end terminating in a protruded retaining head 321. The shell 31 has a sloping sidewall 311 corresponding to the sloping sidewall 151 of the front sliding track 15 and the sloping sidewall 261 of the rear sliding track 26 and adapted to limit upward movement of the respective sliding retainer 3 in the sliding track 15 or 26, and an inwardly extending hooked portion 312. The bottom block 33 has a stop flange 331 corresponding to the hooked portion 312 of the shell 31 and adapted to limit downward movement of the retaining rod 32 in the shell 31. Further, the retaining rod 32, subject to the stop flange 331 and the hooked portion 312, is slidable up and down within the shell 31.

Figure 4:
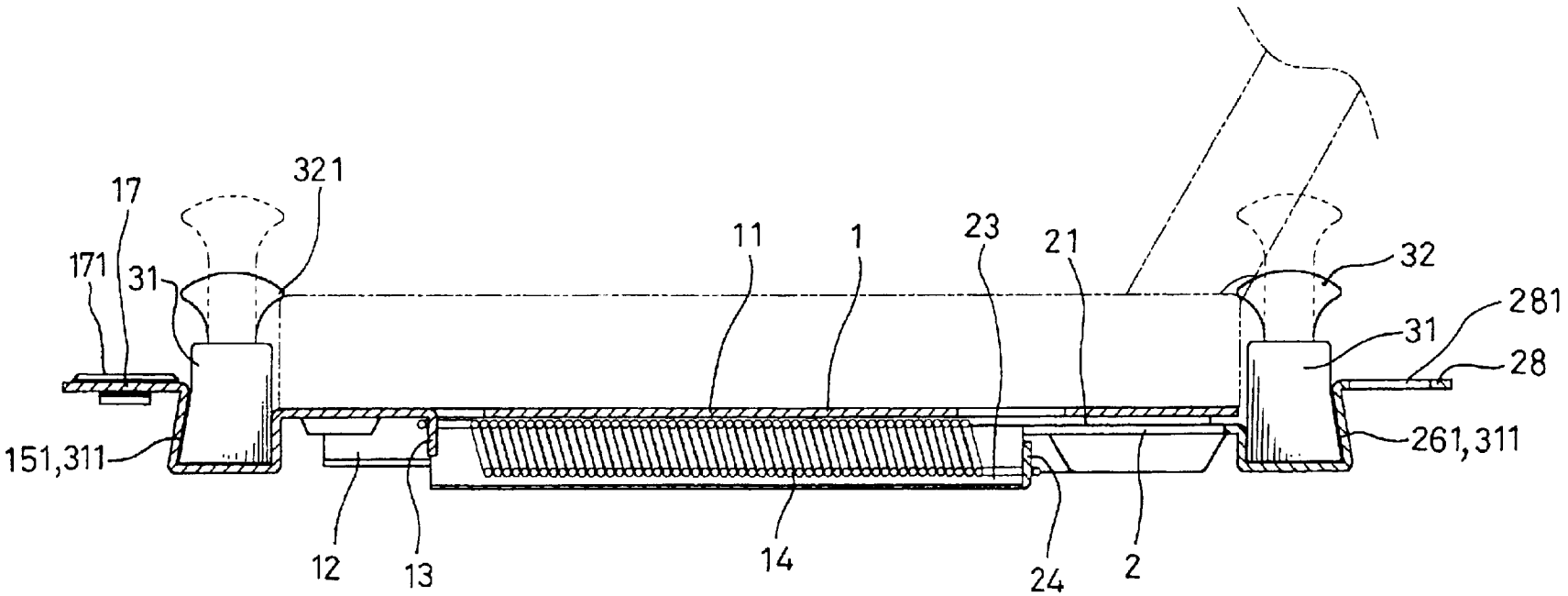
FIG. 4 is a schematic drawing showing a mobile computer secured to the mobile computer rack according to the present invention.

When in use, the carrier plate 1 is pulled out of the mounting plate 2 to expand the distance between the front sliding track 15 and the rear sliding track 26 for enabling the mobile computer to be loaded on the carrier plate 1 and the mounting plate 2 and stopped between the front sliding track 15 and the rear sliding track 26, and then the sliding retainers 3 are respectively inserted into the front sliding track 15 and the rear sliding track 26, and then the retaining rods 32 of the sliding retainers 3 are adjusted within the shell 31 so that the protruded retaining heads 321 of the retaining rods 32 engage a top edge of the mainframe of the mobile computer (see FIG. 4).

The aforesaid mobile computer rack can be fixedly fastened to a sliding track assembly at the bottom sidewall of the table top of a computer desk or the like for holding a mobile computer, for enabling the mobile computer to be moved in and out of the computer desk.

A prototype of mobile computer rack has been constructed with the features of FIGS. 1~4. The mobile computer rack functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A mobile computer rack comprising a mounting plate, said mounting plate comprising a flat body adapted to support a mobile computer, two sliding rails provided at two opposite lateral sides of said flat body, a longitudinal groove located on said flat body on the middle between said sliding rails, a rear sliding track transversely extended along a rear side of said flat body, and a hook provided in one end of said longitudinal groove near said rear sliding track;

a carrier plate coupled to said mounting plate, said carrier plate comprising a planar bearing face adapted to support the mobile computer carried on said flat body of said mounting plate, two side tracks extended along two opposite lateral sides of said planar bearing face and respectively coupled to said sliding rails of said mounting plate for enabling said carrier plate to be moved in and out of said mounting plate, a bottom hook provided on the middle, and a front sliding track transversely extended along a front side of said planar bearing face and adapted to work with said rear sliding track to hold the loaded mobile computer on said planar bearing face of said carrier plate and said flat body of said mounting plate;

spring means connected between the hook of said carrier plate and the hook of said mounting plate and adapted to pull said carrier plate toward said mounting plate; and a plurality of sliding retainers respectively slidably mounted in said front sliding track and said rear sliding track and adapted to hold down the loaded mobile computer on said planar bearing face of said carrier plate and said flat body of said mounting plate, wherein said sliding retainers each comprise a shell, a retaining rod vertically movably inserted through said shell, and a bottom block fixedly fastened to a bottom end of said retaining rod to secure said retaining rod to said shell and to limit vertical moving distance relative to said shell.

2. The mobile computer rack as claimed in claim 1, wherein said front sliding track and said rear sliding track each have two distal open ends respectively sealed with a respective end cap.

3. The mobile computer rack as claimed in claim 1, wherein the carrier plate further comprises a handle located on a front side of said front sliding track.

4. The mobile computer rack as claimed in claim 3, wherein said handle is provided with a nameplate.

5. The mobile computer rack as claimed in claim 1, said mounting plate further comprises a horizontal rear extension plate provided at a rear side of said rear sliding track, said horizontal rear extension plate having at least one through hole for the mounting of a computer lock.

6. The mobile computer rack as claimed in claim 1, wherein said planar bearing face of said carrier plate and said flat body of said mounting plate each have a plurality of elongated air vents.

7. The mobile computer rack as claimed in claim 1, wherein said bottom block has a stop flange, said shell has a hooked portion adapted to hook said stop flange and to limit downward movement of said retaining rod and said bottom block relative to said shell.

8. The mobile computer rack as claimed in claim 1, wherein said flat body of said mounting plate has a plurality of mounting holes for mounting.

9. The mobile computer rack as claimed in claim 1, wherein said spring means is a coiled spring.

* * * * *